US005853213A

United States Patent [19]

Simpson

[11] Patent Number: 5,853,213

[45] Date of Patent: Dec. 29, 1998

[54] IN-LINE SKATE CARRIER

[76] Inventor: Tyler C. Simpson, 555 Del Oro, Ojai, Calif. 93023

[21] Appl. No.: 941,137

[22] Filed: Sep. 30, 1997

[51] Int. Cl.[6] ..... A45F 5/10

[52] U.S. Cl. ..... 294/158; 294/159; 294/170

[58] Field of Search ..... 294/137, 143, 294/145, 147, 153, 154, 158, 159, 162, 170; 224/103, 255, 257, 921

[56] References Cited

U.S. PATENT DOCUMENTS

| | | | |
|---|---|---|---|
| 825,753 | 7/1906 | Paul | 224/921 |
| 1,117,298 | 11/1914 | Zaar et al. | 294/170 |
| 3,188,130 | 6/1965 | Pietrowicz | 294/170 |
| 3,315,574 | 4/1967 | Field et al. | 294/158 |
| 3,636,594 | 1/1972 | Faivre | 294/170 |
| 4,242,813 | 1/1981 | Quance | 294/159 |
| 4,483,470 | 11/1984 | Cousins | 294/159 |
| 5,709,425 | 1/1998 | Cordova | 294/158 |

*Primary Examiner*—Dean Kramer

[57] ABSTRACT

A new In-Line Skate Carrier for holding and carrying in-line skates when not in use. The inventive device includes a cord, a handle assembly coupled to and provided intermediate the ends of the cord, and a pair of flexible discs perpendicularly secured to the ends of the cord wherein the flexible discs are adapted for retaining and supporting a pair of in-line skates on the cord. Accordingly, one of the flexible discs is insertable through an opening provided in the wheel assembly of a first in-line skate and the other flexible disc is insertable through an opening provided in the wheel assembly of a second in-line skate whereby the flexible discs support the pair of in-line skates on the cord.

13 Claims, 3 Drawing Sheets

FIG. 1
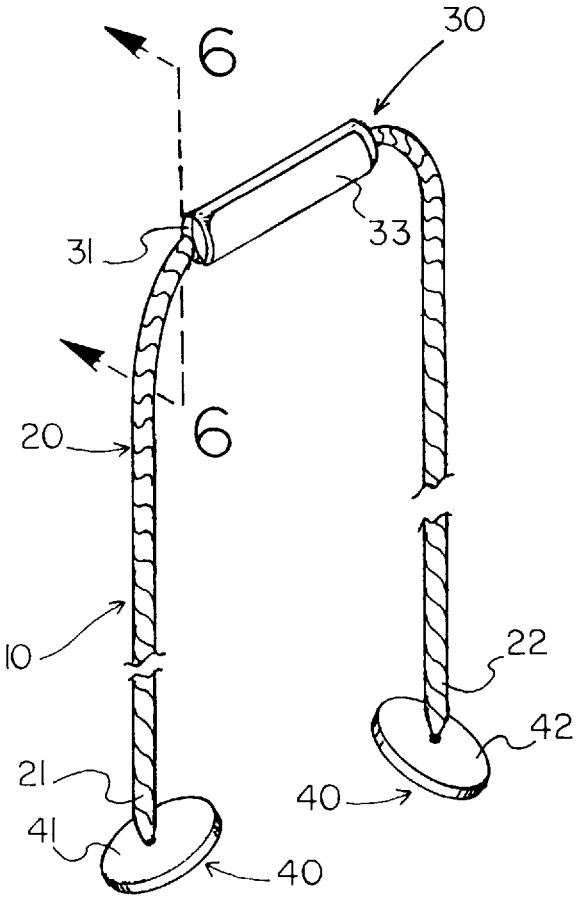
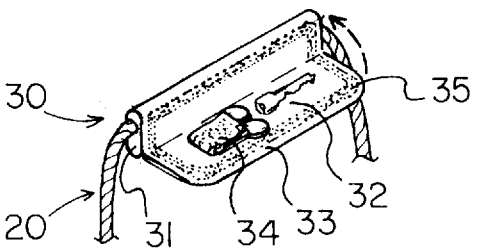
FIG. 2
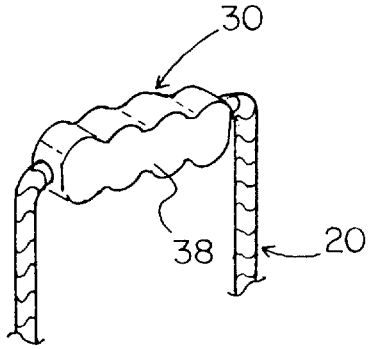
FIG. 3
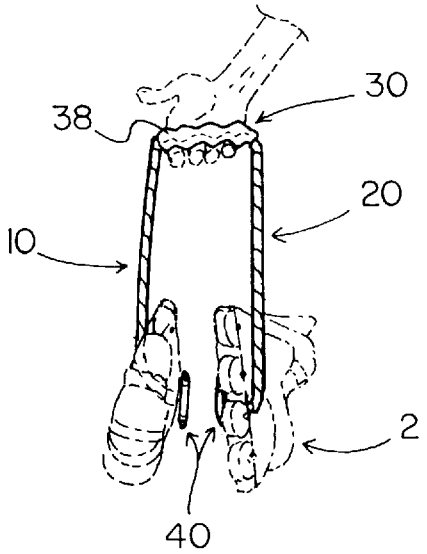
FIG. 4

FIG. 5
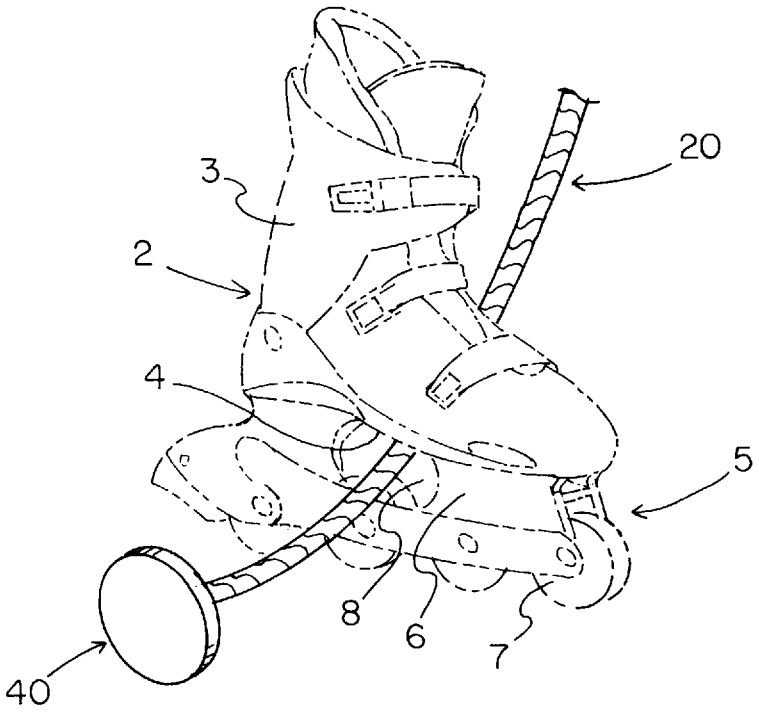
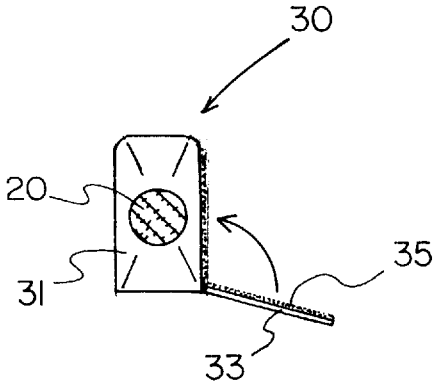
FIG. 6

IN-LINE SKATE CARRIER

BACKGROUND OF THE INVENTION

1. Field of the Invention

The present invention relates to carrier devices and more particularly pertains to a new In-Line Skate Carrier for holding and carrying in-line skates when not in use.

2. Description of the Prior Art

The use of carrier devices is known in the prior art. More specifically, carrier devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art carrier devices include U.S. Pat. No. 4,277,006; U.S. Pat. No. 4,331,357; U.S. Pat. No. 4,363,514; U.S. Pat. No. 5,269,580; U.S. Pat. No. D335,576; and U.S. Pat. No. D256,521.

While these devices fulfill their respective, particular objectives and requirements, the aforementioned patents do not disclose a new In-Line Skate Carrier. The inventive device includes a cord, a handle assembly coupled to and provided intermediate the ends of the cord, and a pair of flexible discs perpendicularly secured to the ends of the cord wherein the flexible discs are adapted for retaining and supporting a pair of in-line skates on the cord. Accordingly, one of the flexible discs is insertable through an opening provided in the wheel assembly of a first in-line skate and the other flexible disc is insertable through an opening provided in the wheel assembly of a second in-line skate whereby the flexible discs support the pair of in-line skates on the cord.

In these respects, the In-Line Skate Carrier according to the present invention substantially departs from the conventional concepts and designs of the prior art, and in so doing provides an apparatus primarily developed for the purpose of holding and carrying in-line skates when not in use.

SUMMARY OF THE INVENTION

In view of the foregoing disadvantages inherent in the known types of carrier devices now present in the prior art, the present invention provides a new In-Line Skate Carrier construction wherein the same can be utilized for holding and carrying in-line skates when not in use.

The general purpose of the present invention, which will be described subsequently in greater detail, is to provide a new In-Line Skate Carrier apparatus and method which has many of the advantages of the carrier devices mentioned heretofore and many novel features that result in a new In-Line Skate Carrier which is not anticipated, rendered obvious, suggested, or even implied by any of the prior art carrier devices, either alone or in any combination thereof.

To attain this, the present invention generally comprises a cord, a handle assembly coupled to and provided intermediate the ends of the cord, and a pair of flexible discs perpendicularly secured to the ends of the cord wherein the flexible discs are adapted for retaining and supporting a pair of in-line skates on the cord. Accordingly, one of the flexible discs is insertable through an opening provided in the wheel assembly of a first in-line skate and the other flexible disc is insertable through an opening provided in the wheel assembly of a second in-line skate whereby the flexible discs support the pair of in-line skates on the cord.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new In-Line Skate Carrier apparatus and method which has many of the advantages of the carrier devices mentioned heretofore and many novel features that result in a new In-Line Skate Carrier which is not anticipated, rendered obvious, suggested, or even implied by any of the prior art carrier devices, either alone or in any combination thereof.

It is another object of the present invention to provide a new In-Line Skate Carrier which may be easily and efficiently manufactured and marketed.

It is a further object of the present invention to provide a new In-Line Skate Carrier which is of a durable and reliable construction.

An even further object of the present invention is to provide a new In-Line Skate Carrier which is susceptible of a low cost of manufacture with regard to both materials and labor, and which accordingly is then susceptible of low prices of sale to the consuming public, thereby making such In-Line Skate Carrier economically available to the buying public.

Still yet another object of the present invention is to provide a new In-Line Skate Carrier which provides in the apparatuses and methods of the prior art some of the advantages thereof, while simultaneously overcoming some of the disadvantages normally associated therewith.

Still another object of the present invention is to provide a new In-Line Skate Carrier for holding and carrying in-line skates when not in use.

Yet another object of the present invention is to provide a new In-Line Skate Carrier which includes a cord, a handle assembly coupled to and provided intermediate the ends of the cord, and a pair of flexible discs perpendicularly secured to the ends of the cord wherein the flexible discs are adapted for retaining and supporting a pair of in-line skates on the cord. Accordingly, one of the flexible discs is insertable through an opening provided in the wheel assembly of a first in-line skate and the other flexible disc is insertable through an opening provided in the wheel assembly of a second in-line skate whereby the flexible discs support the pair of in-line skates on the cord.

Still yet another object of the present invention is to provide a new In-Line Skate Carrier that is portable and, as such, may be easily stored on a person, for example, in a clothing pocket, when not in use.

Even still another object of the present invention is to provide a new In-Line Skate Carrier that includes a storage compartment for small objects including keys, money, etc.

Even still another object of the present invention is to provide a new In-Line Skate Carrier that could be used for hanging storage of in-line skates when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an illustration of a new In-Line Skate Carrier according to the present invention.

FIG. 2 is an illustration of the storage compartment provided in a first embodiment of the handle of the present invention.

FIG. 3 is a second embodiment of the handle of the present invention.

FIG. 4 is an illustration of the present invention in use.

FIG. 5 is an illustration of the flexible disc and one end of the cord of the present invention inserted through an opening in the wheel assembly of an in-line skate.

FIG. 6 is a cross sectional view taken along line 6-6 of FIG. 1.

DESCRIPTION OF THE PREFERRED EMBODIMENT

Figure 7:
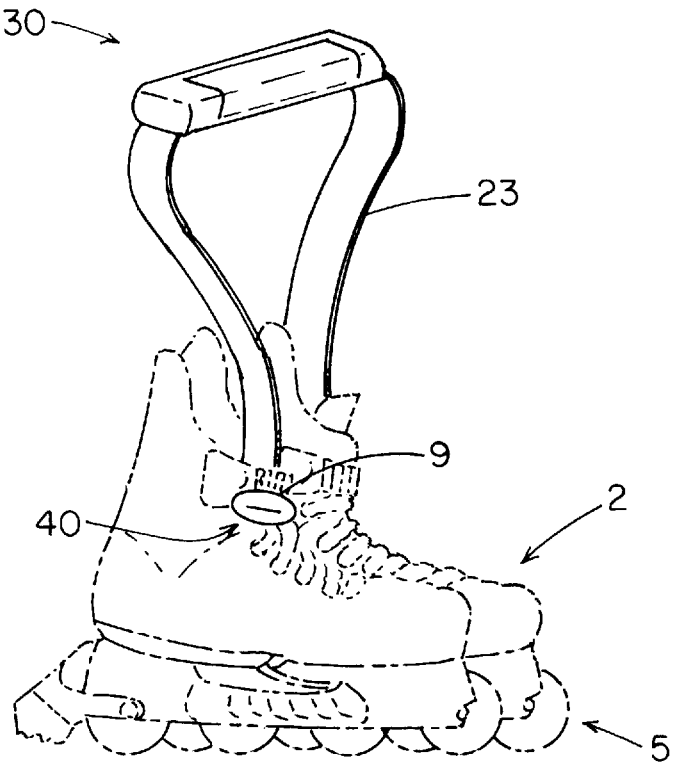
FIG. 7 is an illustration of the flexible disc and one end of the cord of the flat cord embodiment of the present invention inserted through the lacing of an in-line skate.

With reference now to the drawings, and in particular to FIGS. 1 through 6 thereof, a new In-Line Skate Carrier embodying the principles and concepts of the present invention and generally designated by the reference numeral 10 will be described.

As best illustrated in FIGS. 1 through 6, the In-Line Skate Carrier 10 comprises a cord 20, a handle assembly 30 coupled to and provided intermediate the ends of the cord 20, and a pair of flexible discs 40 perpendicularly secured to the ends of the cord 20 wherein the flexible discs 40 are adapted for retaining and supporting a pair of in-line skates 2 on the cord 20. Accordingly, one of the flexible discs 40 is insertable through an opening 8 provided in the wheel assembly 5 of a first in-line skate 2 and the other flexible disc 40 is insertable through an opening 8 provided in the wheel assembly 5 of a second in-line skate 2 whereby the flexible discs 40 support the pair of in-line skates 2 on the cord 20.

The In-Line Skate Carrier 10 is intended for use in holding and carrying a pair of in-line skates 2 as illustrated in FIGS. 4 and 5. Each in-line skate 2 includes a boot 3 formed with a sole 4 to which is affixed a wheel assembly 5 including a frame 6 and a plurality of wheels 7 mounted in-line thereon. More importantly, each in-line skate 2 has an opening 8 therein formed either in the frame 6 of the wheel assembly 5 or between the boot 3 and the wheel assembly 5. It is to be understood that the In-Line Skate Carrier 10 may also be used in holding and carrying roller skates as well as ice skates.

As best illustrated in FIG. 1, the cord 20 has a first end 21 and a second end 22. The cord 20 consists of either one continuous piece extending through the handle assembly 30 or two equal segments each secured to opposite sides of the handle assembly 30. In an illustrative embodiment, the cord 20 is formed of ¼ inch diameter nylon rope and extends from opposite sides of the handle assembly 30 for a length of about 12 to 13 inches.

The handle assembly 30 is positioned intermediate the first end 21 and the second end 22 of the cord 20 so as to substantially and evenly distribute the weight of the pair of in-line skates 2. In a first embodiment, the handle assembly 30 comprises an elongated substantially rigid member 31 (FIGS. 1 and 2). The rigid member 31 either completely surrounds a length of the cord 20 or a segment of the cord 20 is secured to and extends from each side of the rigid member 31.

In a preferred embodiment, the rigid member 31 includes a storage compartment 32 comprising a releasable flap 33 secured along a bottom edge of the rigid member 31. The releasable flap 33 is openable to reveal a storage pocket 34 sized for retaining small objects including keys, money, etc. The releasable flap 33 includes a releasable fastener 35, such as a snap or a hook and loop fastener, for use in releasably closing the storage compartment 32.

Figure 8:
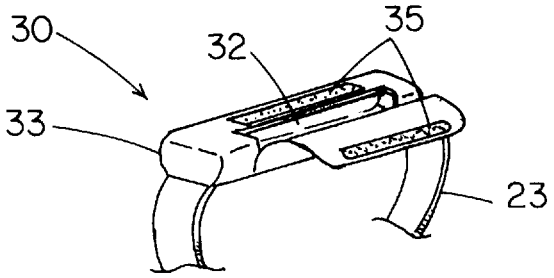
FIG. 8 is an illustration of an optional embodiment of the storage compartment provided in the flat cord embodiment of the handle of the present invention.

With reference to FIG. 8, an optional embodiment of the handle assembly 30 is shown. In this embodiment, the handle assembly 30 is in a horizontal orientation with the storage compartment 32 opening on the top of the handle assembly 30 rather than on the side.

In a second embodiment, the handle assembly 30 comprises a hand grip 38 through which a length of the cord passes (FIGS. 3 and 4). In a preferred embodiment, the hand grip 38 is contoured and formed for ease of gripping thereof in one hand.

As best illustrated in FIG. 1, the pair of flexible discs 40 comprises a first flexible disc 41 and a second flexible disc 42 wherein the first flexible disc 41 is secured to the first end 21 of the cord 20 and the second flexible disc 42 is secured to the second end 22 of the cord 20. Each of the flexible discs 40 are secured to an end of the cord 20 such that the end of the cord 20 extends perpendicularly from a center of the flexible disc 40. Each of the flexible discs 40 are flexible yet sufficiently stiff such that each may be fitted through the opening 8 in the wheel assembly 5 and yet support one of the in-line skates 2 on the cord 20. In an illustrative embodiment, each of the flexible discs 40 are about 1¼ inch in diameter and about 2mm thick.

In a third embodiment of the invention (FIGS. 7 and 8), the cord is a flat cord 23 rather than a cylindrical cord 20. In this embodiment, as shown in FIG. 7, the cord 23 and the flexible discs may be threaded through a portion of the laces 9 of a in-line skate 2 for convenient carrying of the inline skate.

In use, the skater would fit the first flexible disc 41 through the opening 8 provided in the wheel assembly 5 of the first in-line skate 2 and then fit the second flexible disc 42 through the opening 8 provided in the wheel assembly 5 of the second in-line skate 2. Accordingly, the skater could then grasp the handle assembly 30 and more easily carry the pair of in-line skates 2. As such, the skater may carry the pair of in-line skates 2 with one hand when not in use. Alternatively, the skater could drape the cord 20 and the pair of in-line skates 2 over his or her shoulder. Furthermore, the skater could drape the cord 20 over a peg (not shown) for efficient and tidy storage of the pair of in-line skates 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An apparatus for carrying a pair of in-line skates each including a boot and a wheel assembly depending therefrom and having an opening amongst said boot and said wheel assembly, said apparatus comprising:

a cord having a first end and a second end;

a handle assembly coupled to and positioned intermediate said first end and said second end of said cord; and a pair of discs perpendicularly secured to said first end and said second end of said cord, each of said pair of discs being insertable through said opening provided amongst said boot and said wheel assembly of one of said pair of in-line skates, whereby each of said pair of discs retain and support one of said pair of in-line skates on said cord;

wherein said handle assembly includes an elongated substantially rigid member having a top edge and a bottom edge; and wherein a first segment of said cord is secured to and extends from a first side of said rigid member and wherein a second segment of said cord is secured to and extends from a second side of said rigid member.

2. The apparatus of claim 1, wherein said rigid member includes a storage compartment.

3. The apparatus of claim 1, wherein said handle assembly comprises a hand grip.

4. The apparatus of claim 3, wherein a first segment of said cord is secured to and extends from a first side of said hand grip and wherein a second segment of said cord is secured to and extends from a second side of said hand grip.

5. The apparatus of claim 1, wherein said pair of discs further comprises a first flexible disc and a second flexible disc, said first flexible disc secured to said first end of said cord whereby said first end of said cord perpendicularly extends from a center of said first flexible disc and said second flexible disc secured to said second end of said cord whereby said second end of said cord perpendicularly extends from a center of said second flexible disc.

6. The apparatus of claim 5, wherein said rigid member includes a storage compartment.

7. An apparatus for carrying a pair of in-line skates each including a boot and a wheel assembly depending therefrom and having an opening amongst said boot and said wheel assembly, said apparatus comprising:

a cord having a first end and a second end;

a handle assembly coupled to and positioned intermediate said first end and said second end of said cord; and a pair of discs perpendicularly secured to said first end and said second end of said cord, each of said pair of discs being insertable through said opening provided amongst said boot and said wheel assembly of one of said pair of in-line skates, whereby each of said pair of discs retain and support one of said pair of in-line skates on said cord;

wherein said handle assembly includes an elongated substantially rigid member having a top edge and a bottom edge;

wherein said rigid member includes a storage compartment; and wherein said storage compartment comprises:

a releasable flap secured along said bottom edge of said rigid member, said releasable flap openable and closable to reveal and conceal a storage pocket provided within said storage compartment, and said releasable flap including a releasable fastener for use in releasably closing said storage compartment.

8. The apparatus of claim 7, wherein said cord consists of at least one of a single continuous piece extending through said handle assembly and two equal segments each secured to opposite sides of said handle assembly.

9. The apparatus of claim 7, wherein said rigid member surrounds a length of said cord.

10. The apparatus of claim 7, wherein said pair of discs further comprises a first flexible disc and a second flexible disc, said first flexible disc secured to said first end of said cord whereby said first end of said cord perpendicularly extends from a center of said first flexible disc and said second flexible disc secured to said second end of said cord whereby said second end of said cord perpendicularly extends from a center of said second flexible disc.

11. The apparatus of claim 7, wherein said handle assembly comprises a hand grip, said hand grip being contoured and formed for ease of gripping thereof in one hand.

12. The apparatus of claim 11, wherein said hand grip surrounds a length of said cord.

13. An apparatus for carrying a pair of in-line skates each including a boot and a wheel assembly depending therefrom and having an opening amongst said boot and said wheel assembly, said apparatus comprising:

a cord having a first end and a second end;

a handle assembly coupled to and positioned intermediate said first end and said second end of said cord;

a pair of flexible discs comprising a first flexible disc and a second flexible disc, said first flexible disc secured to said first end of said cord whereby said first end of said cord perpendicularly extends from a center of said first flexible disc and said second flexible disc secured to said second end of said cord whereby said second end of said cord perpendicularly extends from a center of said second flexible disc;

each of said pair of flexible discs insertable through said opening provided amongst said boot and said wheel assembly of one of said pair of in-line skates, whereby each of said pair of flexible discs retain and support one of said pair of in-line skates on said cord;

wherein said handle assembly comprises a hand grip, said hand grip being contoured and formed for ease of gripping thereof in one hand; and wherein a first segment of said cord is secured to and extends from a first side of said hand grip and wherein a second segment of said cord is secured to and extends from a second side of said hand grip.

* * * * *